United States Patent [19]

Miyamoto

[11] 4,118,033

[45] Oct. 3, 1978

[54] DEVICE FOR PRACTICING GOLF SWING

[76] Inventor: Toshiyuki Miyamoto, 33-101 Tamagawa 2-chome, Takatsuki City, Osaka, Japan

[21] Appl. No.: 768,372

[22] Filed: Feb. 14, 1977

[51] Int. Cl.[2] ..... A63B 69/36

[52] U.S. Cl. ..... 273/186 A; 273/186 C; 273/193 R; 273/80 B

[58] Field of Search ..... 273/80 B, 193 A, 193 B, 273/193 R, 183 D, 186 A, 194 R, 84, 186 C

[56] References Cited

U.S. PATENT DOCUMENTS

| | | | |
|---|---|---|---|
| 897,201 | 8/1908 | Gannon | 273/84 |
| 1,165,216 | 12/1915 | Weflen | 273/84 |
| 1,524,196 | 1/1925 | Matthews | 273/193 A X |
| 1,662,712 | 3/1928 | Mensing | 273/80 B |
| 1,976,455 | 10/1934 | Nelson | 273/80 B |

OTHER PUBLICATIONS

"Golf World," Apr. 12, 1968.

*Primary Examiner*—George J. Marlo
*Attorney, Agent, or Firm*—Eric P. Schellin

[57] ABSTRACT

A golf-swing-practicing device comprising a flexible shaft having a weight attached to one end of the shaft, the shaft being composed of a composite core member having a plurality of strands twisted around the core, and each of the strands being formed of a plurality of steel wires twisted together. The composite core member includes a flexible core element formed of fibers and a non-flexible core element such as iron arranged in axial end-to-end alignment with each other. The shaft and the weight assembly are provided with a covering of synthetic resin, synthetic rubber or synthetic leather. Through repeated practice, whether indoors or out-of-doors, with use of the device the user can empirically master the various techniques for hitting long shots with a maximum power at impact for hitting the ball with proper timing, and for eliminating wild shots.

7 Claims, 11 Drawing Figures

DEVICE FOR PRACTICING GOLF SWING

BACKGROUND OF THE INVENTION

The present invention relates to a device for practicing the golf swing, and more particularly to a device for mastering the techniques for eliminating wild or mis-hit shots beginners frequently experience, for making long shots and for hitting the golf ball with proper timing.

In order to strike the golf ball with the clubface square to the ball without mis-hitting, the player must address the ball in a proper stance and hit the ball free of the sway of the golf club during the downswing. For this purpose, the clubhead must be swung along a consistent circular path in a plane.

To hit the golf ball a great distance, it is essential that the clubhead strike the ball at a maximum speed, giving a maximum power to the ball. To this end, the wrists must be retained in their cocked position during the downswing from the top of the swing until an instant before the hands and the club grip reach the center of the player's body, i.e., until arriving at the lowermost point of its circular motion. By maintaining the cocked position, it is possible to delay the entrance of the clubhead into the hitting area for the greatest possible time, thereby causing the clubhead to give a maximum impact to the ball with the extra force of the wrists which are then uncocked upon reaching the hitting area.

It is also required that the clubface be positioned at right angles to the target line when hitting a straight shot along the target line. Golfers therefore must master the timing of the impact so that they can bring the body into the proper form at impact by shifting the body weight and turning the hips.

However, beginners frequently experience mis-hit shots because the clubhead tends to sway during the swing. In addition, they frequently uncock the wrists prematurely before the hands and grip have come down to the lowermost point of its circular motion, with the result that the fully uncocked wrists are then unable to generate the desired increased clubhead speed at impact. By not giving the ball a maximum of power, it consequently fails to achieve a long distance. It is further difficult for beginners to master the body movement timed with the entrance of the clubhead into the hitting area. Accordingly, they are unable to shift the body weight and turn the hips so as to bring the body into the proper form at impact.

Devices heretofore used for practicing the golf swing comprise a shaft in the form of a metal, glass fiber or synthetic resin pipe having no flexibility, and a weight attached to one end of the shaft. Such devices are all intended to strengthen the muscles required for the golf swing or to impart enhanced firmness to the grip but are not useful in overcoming the problems described above.

SUMMARY OF THE INVENTION

This invention relates to an improved device for practicing the golf swing comprising a unique flexible shaft and a weight attached to one end of the shaft. Repeated practice with use of the present device enables the golfer to swing the golf club along a more definite circular path in a given plane without swaying the club out of the desired path. By delaying the uncocking of the wrists until the last possible instant, and by using the improved swing-practice device, there is a much reduced tendency to mis-hit the ball. This delay of entrance of the clubhead into the hitting area helps better generate a maximum input power into the ball at impact. Use of this device further enables the golfer to master the proper timing of the impact necessary for a straight shot toward the target.

An object of this invention is to provide a device for practicing the golf swing comprising a flexible shaft and a weight attached to one end of the shaft, the shaft being composed of a composite core member having a plurality of strands twisted around the core, and each of the strands being formed of a plurality of steel wires twisted together. The composite core member includes a flexible core element and a non-flexible core element arranged in axial end-to-end alignment with each other, whereby the user can master the technique for eliminating wild shots or mis-hit shots and for hitting long shots and straight shots toward the target.

Another object of this invention is to provide a device of the type described for practicing the golf swing wherein the flexible core element is about $\frac{2}{3}$ the length of the shaft and extends longitudinally of the shaft away from its weight carrying head end, with the non-flexible core element extending over the remaining approximately $\frac{1}{3}$ portion of the length to provide a grip portion. By these proportions, the device can be usable free of the potential hazard that the weight portion might strike the user's body at the end of a swing because the grip portion embodies the non-flexible core element.

Another object of this invention is to provide a device of the type described which can be used in limited indoor space areas, by restricting the flexible shaft to an overall length of from 600 mm to 700 mm.

Another object of this invention is to provide a golf swing practice device of the type described which is provided with an outer covering material of synthetic rubber, synthetic resin or synthetic leather. The covering envelopes the flexible shaft and weight assembly thereof in a manner to enhance the attractiveness of the device.

Other objects of this invention will become more apparent from the detailed description given below with reference to the accompanying drawings.

DESCRIPTION OF THE PREFERRED EMBODIMENT

Figure 1:
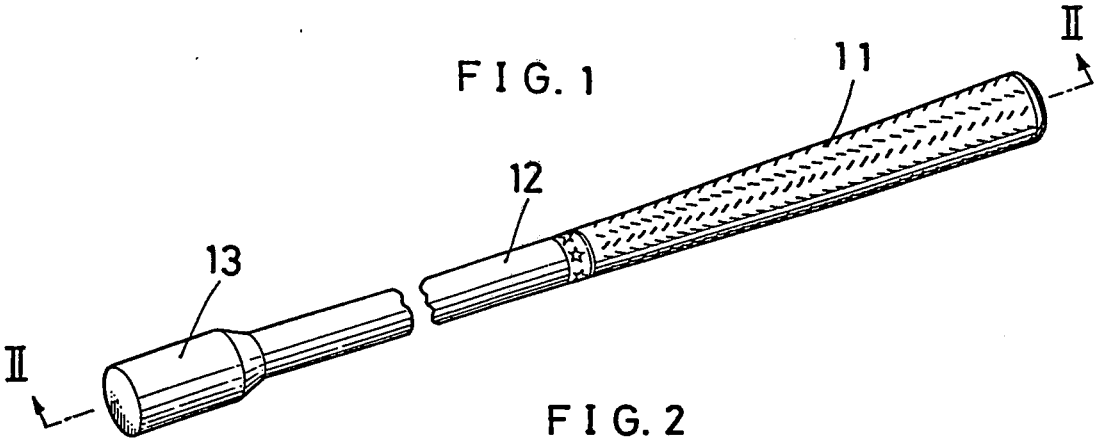
FIG. 1 is a perspective view showing a preferred embodiment of the golf-swing-practicing device, according to the invention, and with the shank portion shown broken to indicate that it is of much greater length.
Figure 2:
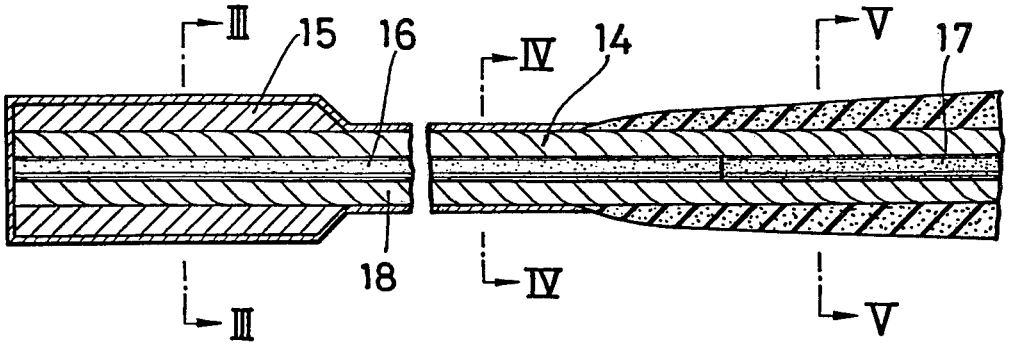
FIG. 2 is a longitudinal cross-sectional view taken along the line II—II in FIG. 1.
Figure 3:
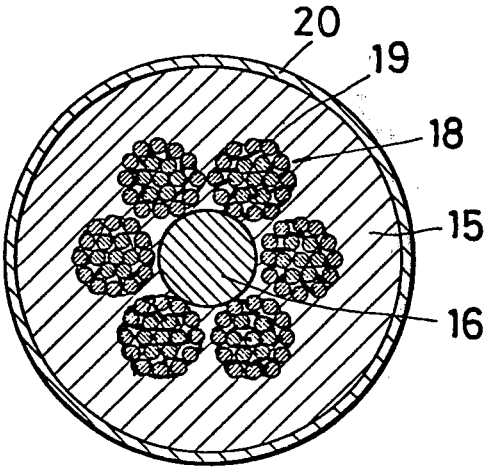
FIG. 3 is an enlarged cross-sectional view taken along the line III—III in FIG. 2.
Figure 4:
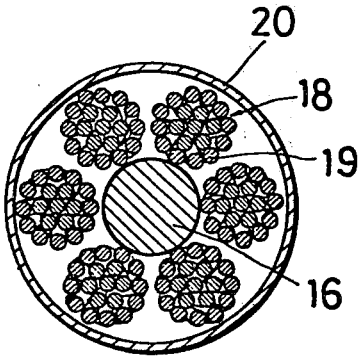
FIG. 4 is a correspondingly enlarged cross-sectional view taken along the line IV—IV in FIG. 2.
Figure 11:
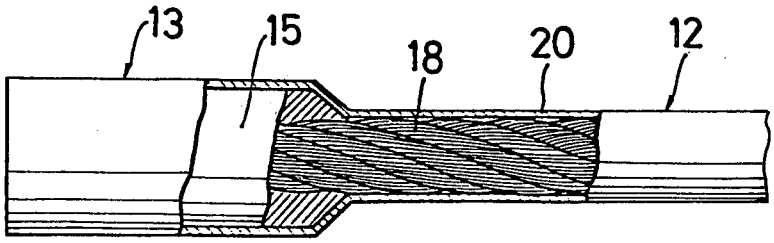
FIG. 11 is partial view showing the present inventive device with a portion of the outer covering removed.
Figure 5:
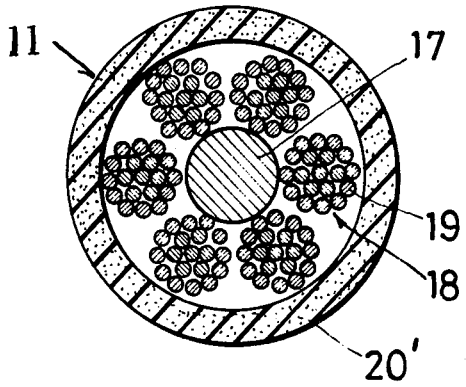
FIG. 5 is a further correspondingly enlarged cross-sectional view taken along the line V—V in FIG. 2.

The golf-swing-practice device of this invention basically comprises a grip portion 11, a shank portion 12 and a head portion 13, assembled by help of a shaft 14 extending through these three portions. The shaft 14 has a weight 15 attached to its one end for providing the head portion 13.

Extending centrally through the shaft 14 is a composite core member including a slender flexible core element 16 and a similarly slender but non-flexible core element 17. The flexible core element 17 is made from threads of fibers, such as hemp, cotton or synthetic fibers, which are twisted together. The non-flexible core element 16 is made of iron, rigid plastic or like material. The two core elements are arranged end-to-end. The flexible core element 16 and the non-flexible core element 17 may be in end-to-end contact with each other or may be slightly spaced apart by a small distance. Strands 18 are each made from a plurality of steel wires 19, such as hard steel wires, piano wires, stainless steel wires or the like, which are twisted together. The strands 18 are spiral twisted around the core in the form of a rope to form the shaft 14.

The number of the steel wires 19 and that of the strands 18 are suitably determined so that the shaft 14 will be 600 mm to 700 mm in overall length, 750 g to 850 g in entire weight and 15 mm to 20 mm in cross-sectional diameter.

The flexible core element 16 extends from the outer end of the head 13 longitudinally of the shaft 14 over a distance corresponding to about $\frac{2}{3}$ the length of the shaft. The non-flexible core element 17 extends over the remaining portion of the shaft length, namely about $\frac{1}{3}$ the length including the grip portion 11.

The weight 15 attached to one end of the shaft 14 is made of lead, brass, stainless steel, iron or like material. To form the weight 15 on the shaft 14, molten metal is poured into a mold, with the end of the shaft 14 placed therein. The metal will then penetrate into the spaces between the steel wires 19 of the strands 18, with the result that the weight 15 can be tightly secured to the shaft 14 without any likelihood that the weight 15 will be detached from the shaft 14 when the device is swung.

The head portion 13, shank portion 12 and grip portion 11 are provided with a covering 20 which may be of synthetic rubber, synthetic leather, or synthetic resin or like material. The covering material 20' on the grip portion 11 preferably is in the form of a hollow truncated cone having an increasing diameter toward its outer end to render the grip portion 11 easy to grip. The covering 20 over the shank portion 12 is in the form of a synthetic resin tube. The covering 20 over the head portion 13 has a shape in conformity with the shape of the weight 15, and is unitary with the other cover portions.

Figure 6:
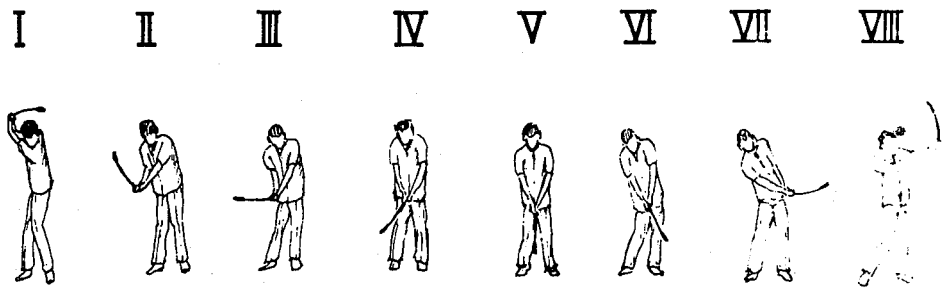
FIG. 6 is a frontal view showing the sequential various positions from start to finish of the recommended continuous motion of a golfer who is practicing his golf swing by use of the subject invention device.

The golf-swing-practicing device of the foregoing structure will be used in the following manner. The user grips the grip portion 11 with his right hand and swings the device several times toward an imaginary ball in a given position. Next, the user similarly swings the device with his left hand. The device is thereafter swung several times with both hands as seen in FIG. 6, as in the case of the usual golf club. These procedures are repeated for practice.

When the device is briskly swung, the head portion 13 moves along a definite circular path within a given plane, because the head portion 13 includes a weight on the flexible shaft 14. When the device is used for repeated practice, the flexibility of the flexible shaft 14 and the gravity on the weight 15 permits the head portion 13 to follow a definite circular path in a plane at all times, as when a string is swung around with a small stone attached to its one end. Thus, the device assures a steady grip without entailing swaying, thereby giving the user the same feeling as when the usual golf club is swung with its head moved along a consistent circular path in a plane. This serves to eliminate the potential sway of the clubhead and therefore also reduce or eliminate wild or mis-hit shots.

Figure 8:
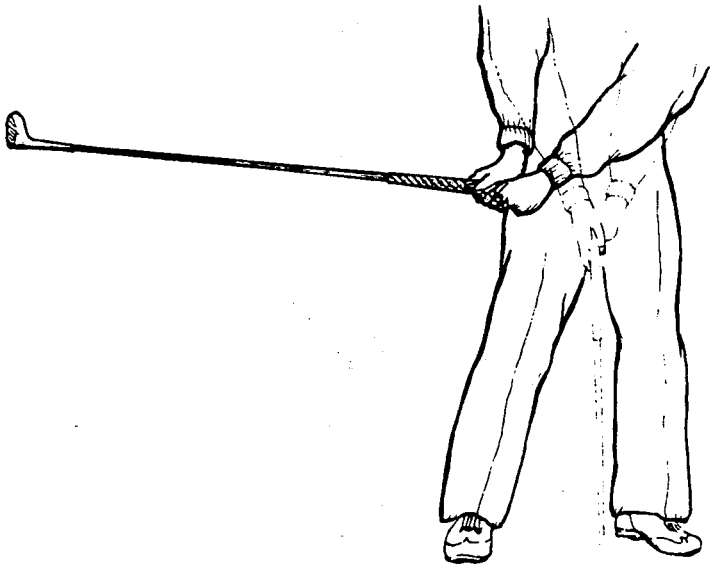
FIG. 8 is a view showing the desired movement of the wrists during the downswing of a golf club in which the cocked wrists (shown in solid lines) are about to be uncocked as the club grip is sufficiently brought down.
Figure 7:
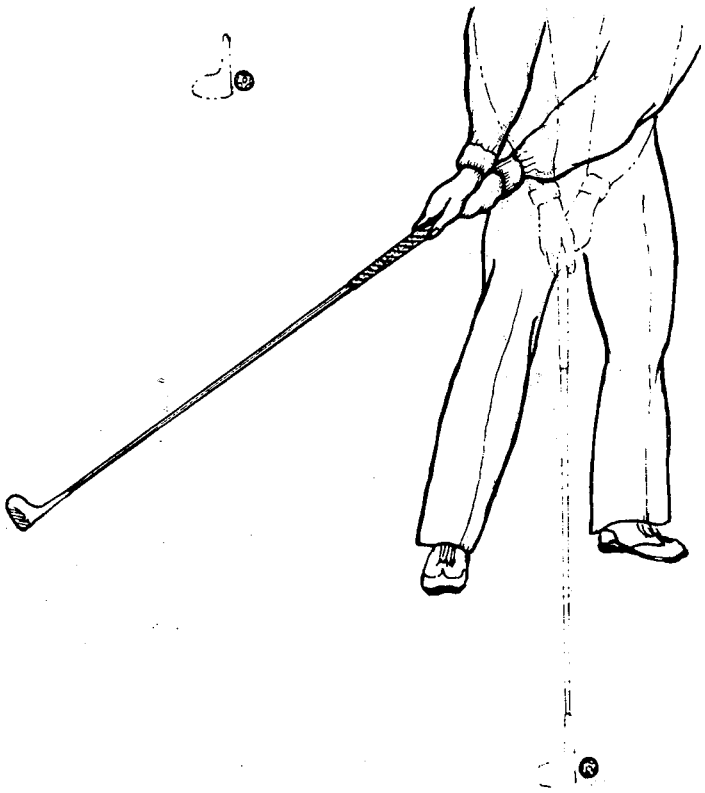
FIG. 7 is a view showing an undesirable movement of the wrists during the swing of a golf club in which the wrists are uncocked before the hands and club grip reach bottom dead center.
Figure 9:
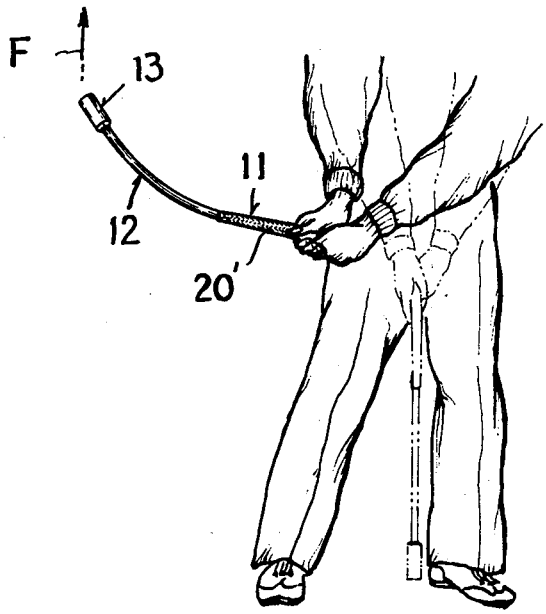
FIG. 9 is a view similar to FIG. 8 showing the cocked position of the wrists in solid line, and where they are uncocked shown in broken outline during the swing of the present inventive device.

As already described under the heading of "Background of the Invention", it is essential to delay the uncocking of the wrists as long as possible in order to achieve the greatest clubhead speed at impact. However, if the wrists are uncocked too soon before the clubhead hits the ball during the time that the grip moves down to a sufficiently low position during the downswing as illustrated in FIG. 7, the wrists can no longer be further uncocked at the last instant to give a maximum of power to the ball at impact. Thus as previously stated, if the wrists are held in their cocked position until the hand grip descends fully to a low portion of the body and thereafter uncocked immediately before the impact as seen in FIG. 8, the clubhead produces a maximum impact power, hitting the ball a great distance. Since the device has the weight 15 on one end of the flexible shaft 14, the flexibility of the shaft 14 and the gravity on the weight during the downswing combine to exert a force F (FIG. 9) acting on the wrists in the direction opposite to the direction of their downward movement and thereby help prevent the wrists from uncocking as shown in FIG. 9. Accordingly, with this device, the user is forced to delay the uncocking of the wrists. Consequently, the wrists coming downward in the cocked position can be uncocked immediately just before the impact. Repeated practice with use of the present device therefore enables the user to master the technique for delaying the uncocking of the wrists so as to deliver a maximum impact force to the ball for a long shot.

Figure 10:
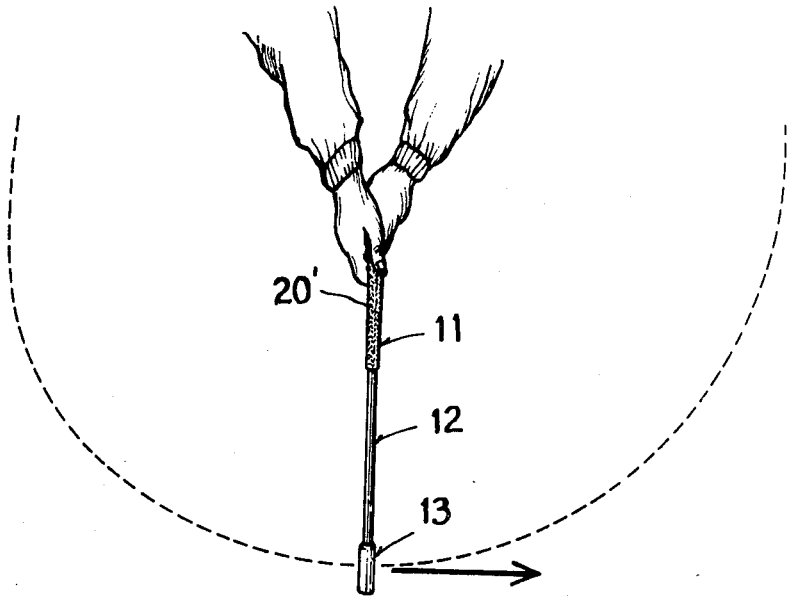
FIG. 10 is a view showing the present inventive device in its fully extended straight position during bottom dead center of the swing.

Further when the head portion 13 of temporarily flexed shaft 14 comes down around into alignment with its grip portion 11, with the wrists in their lowermost position as illustrated in FIG. 10, the weight 15 is greatly swung forward, exerting a forwardly directed force on the wrists as well as on the body and giving the user the feeling of being pulled longitudinally of the shaft 14. This enables the user to master the timing of the impact, invariably entailing a weight shift and a hip turn to bring the body into the proper form at impact.

What is claimed is:

1. A golf-swing-practicing device embodying in combination an assembly of components comprising a shaft having a weight attached to one end of the shaft; said shaft being composed of a composite core member and a plurality of strands twisted around said core member;

each of the strands being formed of a plurality of steel wires twisted together; and said composite core including a flexible core element and an adjacent non-flexible core element arranged substantially in end-to-end axial alignment with each other.

2. A device as defined in claim 1, wherein said flexible core element is about $\frac{2}{3}$ the length of the shaft and extends longitudinally of the shaft away from its weight carrying end, and said non-flexible core element extends over the remaining approximately $\frac{1}{3}$ portion of the shaft length.

3. A device as defined in claim 1, wherein said shaft is 600 mm to 700 mm in overall length.

4. A device as defined in claim 3, wherein the assembled components have a weight of from 750–800 grams.

5. A device as defined in claim 3, wherein said shaft is from 15–20 mm in cross-sectional diameter.

6. A device as defined in claim 1 wherein said shaft and attached weight form a unitary assembly which is provided with an outer covering.

7. A device as defined in claim 6, wherein said covering is of a material selected from a group of materials including synthetic rubber, synthetic resin or synthetic leather covering.

* * * * *